US006992628B2

(12) United States Patent
Rawnick et al.

(10) Patent No.: US 6,992,628 B2
(45) Date of Patent: Jan. 31, 2006

(54) ANTENNA WITH DYNAMICALLY VARIABLE OPERATING BAND

(75) Inventors: James J. Rawnick, Palm Bay, FL (US); Stephen B. Brown, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 76 days.

(21) Appl. No.: 10/647,677

(22) Filed: Aug. 25, 2003

(65) Prior Publication Data

US 2005/0057415 A1 Mar. 17, 2005

(51) Int. Cl.
*H01Q 1/38* (2006.01)

(52) U.S. Cl. ..... 343/700 MS

(58) Field of Classification Search ..... 343/700 MS, 343/775, 840, 912, 757
See application file for complete search history.

(56) References Cited

U.S. PATENT DOCUMENTS

| | | | | |
|---|---|---|---|---|
| 3,581,243 | A | 5/1971 | Alford | |
| 3,681,716 | A | 8/1972 | Chiron et al. | |
| 4,638,271 | A | 1/1987 | Jecko et al. | |
| 4,967,171 | A | 10/1990 | Ban et al. | |
| 5,162,972 | A | 11/1992 | Gripshover et al. | |
| 5,714,112 | A | 2/1998 | Hazeyama et al. | |
| 5,957,969 | A * | 9/1999 | Warner et al. | 607/156 |
| 6,515,235 | B2 | 2/2003 | Moller | |
| 6,633,161 | B1 * | 10/2003 | Vaughan, Jr. | 324/318 |
| 6,781,562 | B1 * | 8/2004 | Lungwitz | 343/900 |

FOREIGN PATENT DOCUMENTS

| | | |
|---|---|---|
| EP | 0 754 660 A1 | 1/1997 |
| EP | 1 089 374 A2 | 4/2001 |
| EP | 1 108 533 | 6/2001 |
| JP | 56-123102 | 9/1981 |
| JP | 05-211402 | 8/1983 |
| JP | 07-015218 | 1/1995 |
| JP | 08-154006 | 6/1996 |
| JP | 08 307117 | 11/1996 |
| JP | 10/190321 | 1/1998 |
| JP | 2000307362 | 11/2000 |
| WO | WO 01-01453 A2 | 1/2001 |

OTHER PUBLICATIONS

Martin et al., Patch antenna in frequency using liquid crystal, 2003, 33rd European microwave conference, pp. 699-702.*

(Continued)

*Primary Examiner*—Don Wong
*Assistant Examiner*—Huedung X. Cao
(74) *Attorney, Agent, or Firm*—Sacco & Associates, PA

(57) ABSTRACT

An antenna can include at least one antenna element (102) to which a fluid dielectric (114) is magnetically and electrically coupled. The antenna element (102) is preferably a conductive wire or patch disposed on a dielectric substrate (104), but it can also be a slot. A fluid control system (116, 118, 120) can be provided responsive to a control signal (124) for selectively varying a volume of the fluid dielectric (114) coupled to the antenna element (102). Consequently, efficient operation of the antenna element can be provided on a plurality of operating bands.

16 Claims, 4 Drawing Sheets

OTHER PUBLICATIONS

Itoh, T.; et al: "Metamaterials Structures, Phenomena and Applications" IEEE Transactions on Microwave Theory and Techniques; Apr., 2005; [Online} Retrieved from the Internet: URL:www.mtt.org/publications/Transactions/CFP__Metamaterials.pdf>.

Kiziltas, G.; et al: "Metamaterial design via the density method" IEEE Antennas and Propagation Society Int'l Symposium 2002, vol. 1, Jun. 16, 2002, pp 748-751, Piscataway.

Salahun, E.; et al: "Ferromagnetic composite-based and magnetically-tunable microwave devices" IEEE MTT-S Microwave Symposium Digest, vol. 2, Jun. 2, 2002 pp1185-1188.

Marques, Ricardo; Medina, Francisco; and Rafii-El-Idrissi, Rachid; "Role of bianisotropy in negative permeability and left handed metamaterials" The American Physical Society, p. 65. <http://physics.uscs/~drs/publications/marques prb 2002.pdf>.

* cited by examiner

ANTENNA WITH DYNAMICALLY VARIABLE OPERATING BAND

BACKGROUND OF THE INVENTION

1. Statement of the Technical Field

The inventive arrangements relate generally to methods and apparatus for multi-band microstrip antenna operation, and more particularly for dynamically changing the operational band of a microstrip antenna.

2. Description of the Related Art

A wide variety of RF antenna elements are commonly manufactured on dielectric substrate. These include common dipole antenna elements as well as a variety of patch and slot type antennas. The band of frequencies over which such antennas will function is largely determined by the geometry of the antenna element, ground plane spacing and characteristics of the dielectric substrate on which the antenna is formed. In many types of antenna element, antenna equivalent impedance changes significantly with frequency. This results in an impedance mismatch to the feed line when the antenna is operated outside a relatively narrow operational bandwidth. If the impedance of different parts of the circuit do not match, this can result in inefficient power transfer, unnecessary heating of components, and other problems. Consequently, the antenna element may not be usable except over a relatively narrow range of operating frequencies.

Two critical factors affecting the performance of the dielectric substrate material are permittivity (sometimes called the relative permittivity or $\in_r$) and permeability (sometimes referred to as relative permeability or $\mu_r$). The relative permittivity and permeability determine the propagation velocity of a signal, which is inversely proportional to $\sqrt{\mu\in}$. These same factors affect the electrical length of an antenna element. Since antenna elements are typically designed to be a particular geometry and size relative to the wavelength of the operating frequency, the choice of the substrate material affects the overall size of the antenna element.

Moreover, conventional substrate materials typically have a permeability of 1. Accordingly, the choice of relative permittivity value for the dielectric substrate is usually a key design consideration. However, once a dielectric substrate material with a particular permittivity is selected, it is generally a static part of the design and cannot be readily changed. Accordingly, the use of conventional dielectric substrate arrangements have proven to be a limitation in designing antennas.

Further, it is known that the size of an antenna element required for a particular frequency can be reduced by selecting a dielectric substrate with a relatively high permittivity. One method of reducing antenna size is through capacitive loading. This can be accomplished through use of a high permittivity substrate for the array elements. For example, if dipole arms are capacitively loaded by placing them on a substrate of high relative permitivity substrate, the dipole arms can be shortened relative to the arm lengths which would otherwise be needed for a particular frequency using a lower dielectric constant substrate. This effect results because the electrical field in high dielectric substrate portion between the arm portion and the ground plane will be concentrated into a smaller dielectric substrate volume.

However, one drawback of this approach is that the radiation efficiency is often reduced. The radiation efficiency is the frequency dependent ratio of the power radiated by the antenna to the total power supplied to the antenna. In the case of a dipole, for example, a shorter arm length reduces the radiation resistance, which is approximately equal to the square of the arm length for a "short" (less than ½ wavelength) dipole antenna as shown below:

$$R_r = 20\,\pi^2 (l/\lambda)^2$$

where l is the electrical length of the antenna line and λ is the wavelength of interest.

A conductive trace comprising a single short dipole can be modeled as an open transmission line having series connected radiation resistance, an inductor, a capacitor and a resistive ground loss. The radiation efficiency of a dipole antenna system, assuming a single mode can be approximated by the following equation:

$$E = \frac{R_r}{(R_r + X_L + X_C + R_L)}$$

Where

E is the efficiency $R_r$ is the radiation resistance $X_L$ is the inductive reactance $X_C$ is the capacitive reactance $X_L$ is the ohmic feed point ground losses and skin effect The radiation resistance is a fictitious resistance that accounts for energy radiated by the antenna. The inductive reactance represents the inductance of the conductive dipole lines, while the capacitor is the capacitance between the conductors. The other series connected components simply turn RF energy into heat, which reduces the radiation efficiency of the dipole.

From the foregoing, it can be seen that the constraints of a dielectric substrate having selected relative dielectric properties often results in design compromises that can negatively affect the electrical performance and/or physical characteristics of the overall circuit. An inherent problem with the conventional approach is that, at least with respect to the substrate, the only control variable for line impedance is the relative permittivity. This limitation highlights another important problem with conventional substrate materials, i.e. they fail to take advantage of the other factor that determines characteristic impedance, namely $L_l$, the inductance per unit length of the transmission line.

SUMMARY OF THE INVENTION

The invention concerns a method for varying an operating band of an antenna. The method can include magnetically and electrically coupling at least one antenna element to a fluid dielectric, and varying a volume of the fluid dielectric to selectively maximize efficiency of the antenna element on a plurality of operating bands. The fluid dielectric can have values of permittivity and permeability that are greater than one so as to facilitate such operation over a plurality of operating bands. For example, the fluid dielectric an include magnetic particles to increase the permeability of the fluid dielectric.

According to one aspect of the invention, the varying step can include controlling the volume to selectively provide an efficient impedance match with an antenna feed circuit of the antenna element for each of the operating bands. According to a second aspect of the invention the varying step can include varying the volume to selectively cause the antenna element to be resonant at the plurality of operating bands. According to another aspect of the invention, the varying step can include varying a capacitive and a magnetic loading of the at least one antenna element.

The method can include coupling the fluid dielectric to the antenna element over a continuous area defined by the at least one antenna element. Alternatively, the fluid dielectric can be distributed over a plurality of separate cavity structures coupled to the antenna element. For example the cavity structures can be distributed about an area defined by the antenna element or they can be spaced from one another along a direction extending from the at least one antenna element to a ground plane of the antenna element.

According to another aspect, the invention can include an antenna. The antenna can include at least one antenna element to which a fluid dielectric is magnetically and electrically coupled. The antenna element is preferably a conductive wire or patch disposed on a dielectric substrate, but it can also be a slot. A fluid control system can be provided responsive to a control signal for selectively varying a volume of the fluid dielectric coupled to the antenna element. Consequently, efficient operation of the antenna element can be provided on a plurality of operating bands.

One or more cavity structures can be defined in the dielectric substrate for constraining the fluid dielectric. A cavity structure can be substantially continuous within an area defined by the antenna element. Alternatively a plurality of cavity structures can be distributed about an area defined by the antenna element. In yet another embodiment, the cavity structures can be spaced from one another along a direction extending from the antenna element toward a ground plane of the antenna element.

A fluid control system can also be provided for varying the fluid dielectric volume. The fluid volume can be controlled to provide an efficient impedance match with an antenna feed circuit of the antenna element for each of the operating bands, to cause the antenna element to be resonant at the plurality of operating bands, and to vary capacitive and a magnetic loading of the antenna element.

DETAILED DESCRIPTION OF THE PREFERRED EMBODIMENTS

Figure 1:
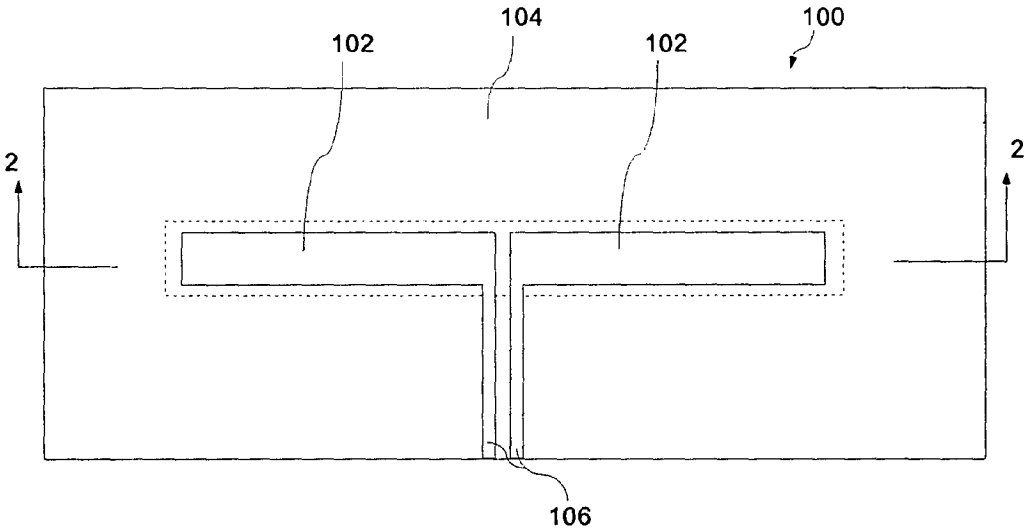
FIG. 1 is a top view of an antenna element that is useful for understanding the invention.

A top view of a variable operating band antenna is shown in FIG. 1. The antenna 100 consists of planar conductive antenna elements 102 disposed on a dielectric substrate 104. The antenna elements in this instance are dipole elements. However, the invention is not so limited and the elements shown are merely intended to be exemplary of one possible element type. In fact any of a wide variety of well known types of planar antenna elements can be used, including patches, spirals, and so on. Accordingly, the invention is not limited to any particular element geometry.

Likewise, the dielectric substrate can be formed of any of a wide variety of commonly available dielectric materials. However, low temperature cofired ceramic substrates are presently preferred. A conductive ground plane is preferably provided below the dielectric substrate 104, spaced apart from the antenna elements 102. The spacing between the antenna elements 102 and the ground plane 110 can vary somewhat but is typically about ¼ wavelength at the operating frequency.

A transmission line antenna feed 106 can be disposed on dielectric substrate 104. However, other feed arrangements can also be used for this purpose, as is well known in the art. For example, dual feed line conductors could be routed through the dielectric substrate 104 to the adjacent ends of the antenna elements. In order to minimize undesirable interaction between the feed structures and the antenna radiating elements, the feed line conductors could be routed perpendicular to the plane defined by the antenna radiating elements. In any case, the invention is not limited to any particular feed arrangement.

In addition to supporting the antenna radiating elements, the dielectric substrate 104 can define at least one cavity structure 108 disposed between the conductive ground plane 110 and the antenna elements 102 as shown. The cavity structure 108 can be at least partially filled with a fluid dielectric 114 and is preferably in fluid communication with a fluid reservoir 112 which can contain also contain fluid dielectric 114.

The areas 128 and 130 of the cavity structure 108 and fluid reservoir 112, respectively are preferably filled with an inert gas. However, the invention is not so limited. For example, these areas can also be filled with a second fluid dielectric that is immiscible with the fluid dielectric 114. In any case, a pressure relief conduit 126 is preferably provided for relieving any pressure differential that may be caused by the movement of fluid dielectric 114 between the cavity structure 108 and the fluid reservoir 112.

A fluid control system can be provided for controlling a volume of fluid in cavity structure 108 that is electrically and magnetically coupled to antenna elements 102. The fluid control system can be comprised of a controller 120 and any suitable combination of pumps, valves, and/or sensors suitable for selectively controlling the volume of fluid dielectric 114 that is coupled to the antenna elements 102. For example, in FIG. 2, valve 116, pump 118 and sensor 122 are provided. The pump 118 transfers fluid dielectric between the cavity structure 108 and the reservoir 112. Sensor 122 provides feedback to indicate when a desired volume of fluid dielectric is present in cavity structure 108. The valve 116 can be closed to prevent additional fluid transfer once the proper volume of fluid dielectric in the cavity structure has been achieved. All of the various functions can be coordinated by the controller 120. Controller 120 can be a microprocessor, a look up table or any other suitable control system for selectively controlling the fluid volume coupled to the antenna elements 102 in response to a control signal 124.

The cavity structure 108 and any fluid dielectric contained therein is electrically and magnetically coupled to the antenna elements 102. Accordingly, by varying the volume of fluid dielectric 114 that is coupled to the antenna elements 102, it is possible to modify the electrical characteristics of the antenna elements. More particularly, if the fluid dielectric has a relatively higher permittivity and/or permeability as compared to the inert gas or second fluid dielectric contained in area 128, then varying the volume of the fluid dielectric 114 will the input impedance and resonant frequency of the antenna elements 102. This in turn will vary the frequency band over which the antenna elements 102 will present an efficient impedance match to the antenna feed 106. Accordingly, varying the volume of the fluid dielectric 114 coupled to the antenna elements 102 can effectively vary the operating band of the antenna.

Figure 2:
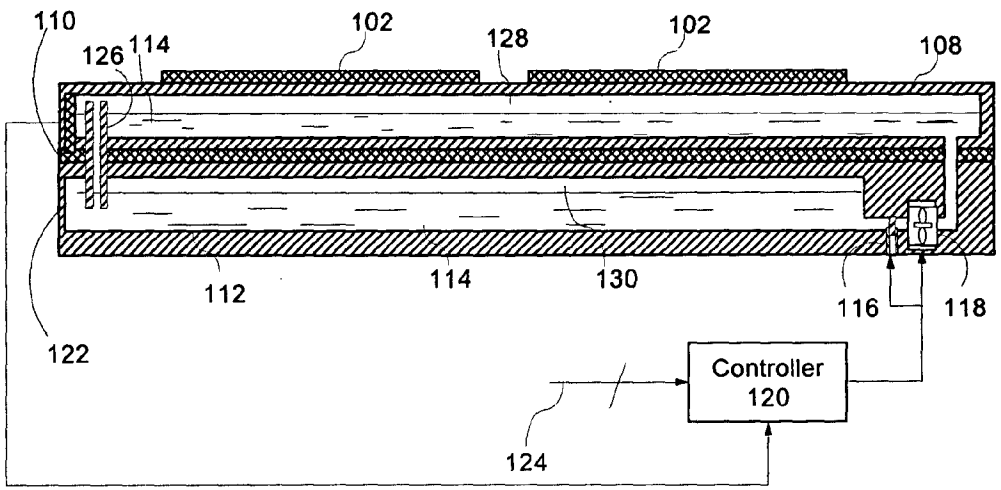
FIG. 2 is a cross-sectional view of the element of FIG. 1 taken along line 2—2.

The system shown in FIGS. 1 and 2 is only one of many possible embodiments by which the volume of fluid dielectric 114 that is magnetically and electrically coupled to the antenna elements 102 can be varied. In FIGS. and 2, a single fluid cavity extends beneath substantially the entire extent of elements 102. However, those skilled in the art will appreciate that other embodiments of the cavity structure are also possible. For example, instead of cavity structure 108 defining a single large cavity, a plurality of smaller interconnected cavities could be arranged in more localized areas in portions of the dielectric substrate. One such alternative embodiment is illustrated in FIGS. 3 and 4 wherein structure common to FIGS. 1 and 2 is indicated using like reference numerals.

Figure 3:
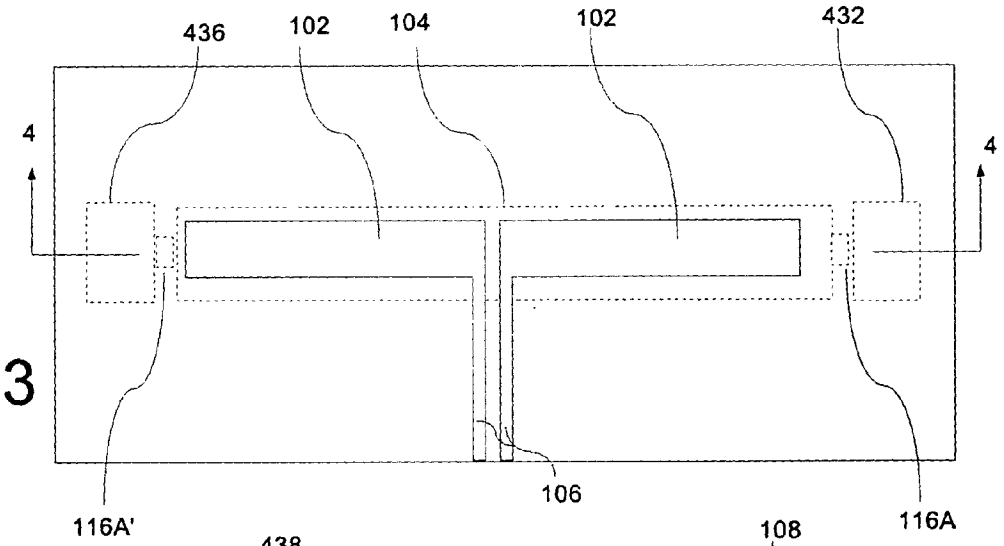
FIG. 3 is top view of a first alternative embodiment of the antenna element in FIG. 1.
Figure 4:
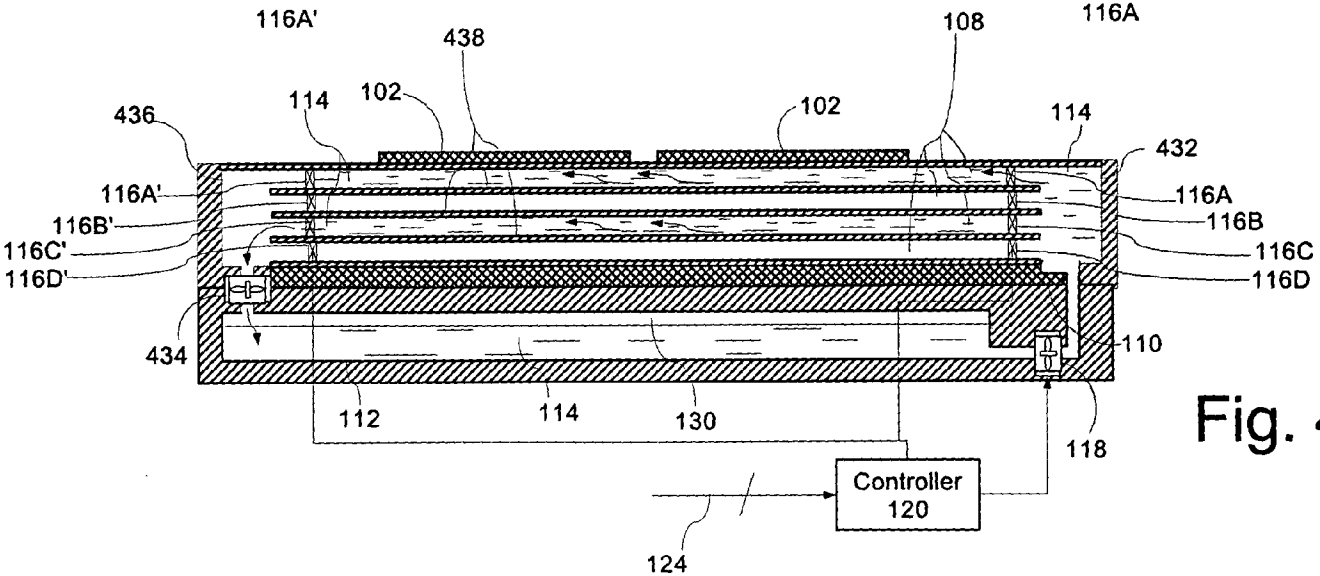
FIG. 4 is a cross-sectional view of the antenna element of FIG. 3 taken along line 3—3.

As shown in FIGS. 3 and 4, instead of a single cavity structure 108, a plurality of such cavity structures 108A, 108B, 108C, 108D can be disposed within the dielectric substrate 104 beneath the antenna elements 102. The individual cavity structures can be separated by dielectric layers 438. Pump 118 can be used to force fluid dielectric 114 under pressure from fluid reservoir 112 into a manifold 432. Thereafter the fluid dielectric 114 can be distributed to one or more of the cavity structures 108A, 108B, 108C, 108D. Valves 116A, 116B, 116C, 116D can control the flow of fluid into the respective cavity structures.

By opening and closing selected valves, fluid dielectric 114 can be added to selected ones of the cavity structures to vary the volume of fluid dielectric coupled to the antenna elements 102 and thereby change the operating band of the antenna. Notably, while only four cavity structures are shown in FIG. 4, the invention is not so limited. Instead, more or fewer cavity structures can be provided for additional or finer degrees of control. The cavity structures 108A, 108B, 108C, 108D can also be drained of fluid dielectric as necessary to adjust the volume of fluid dielectric 114 that is coupled to the antenna elements. For example, a second set of valves 116A', 116B', 116C', 116D' can be provided for this purpose.

According to one embodiment, a second pump 434 can be provided to help draw fluid dielectric out of the cavity structures 108A, 108B, 108C, 108D and into a second manifold 436, before passing back into fluid reservoir 112. As with the embodiment described relative to FIGS. 1 and 2, controller 120 can control the operation of the various pumps and valves in response to a band selector control signal 124.

Figure 5:
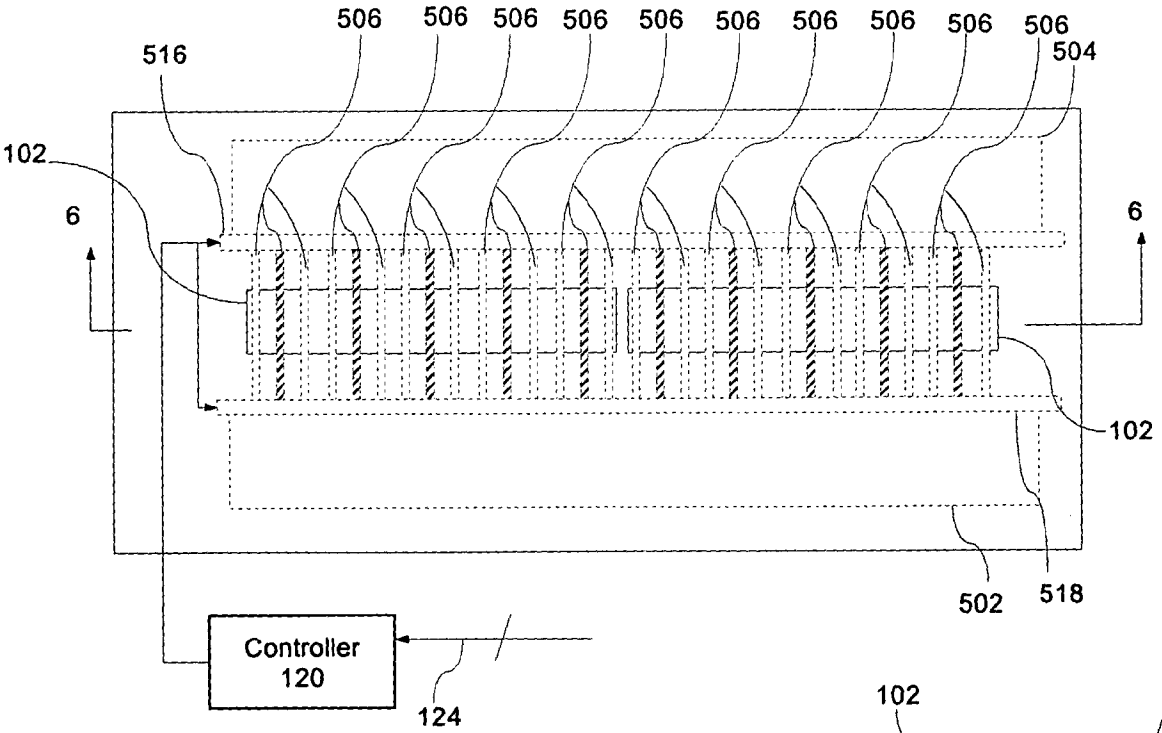
FIG. 5 is a top view of a second alternative embodiment of the antenna element in FIG. 1.
Figure 6:
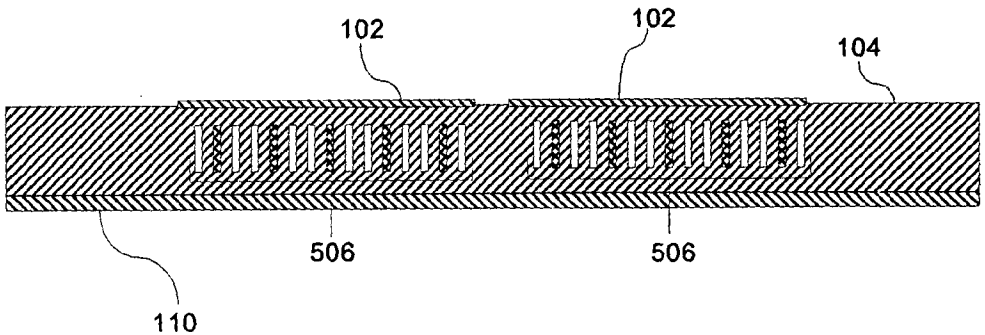
FIG. 6 is a cross-sectional view of the antenna element in FIG. 5.

Still another alternative embodiment of the invention is illustrated in FIG. 5. As illustrated therein, antenna elements 102 can once again be disposed on a dielectric substrate 104. Within the dielectric substrate, there can be provided a high pressure manifold 502 in which the fluid dielectric is maintained under relatively high pressure as compared to the pressure in a low pressure manifold 504. A plurality of capillary like channels 506 can span dielectric substrate 104 in the region below the antenna elements 102 so that any fluid dielectric contained therein will be magnetically and electrically coupled to the elements 102. Valves 516, 518 can be provided on opposing ends of the channels 506 to selectively allow dielectric fluid to be fill or drain from selected ones of the channels.

In FIG. 5, selected channels 506 are filled with fluid dielectric as indicated by the cross-hatching. More or fewer channels 506 can be filled with fluid dielectric to control the volume of fluid dielectric coupled to the antenna elements 102. Controller 120 can control the operation of any valves or pumps as may be needed to selectively move fluid into and out of the channels 506 as described herein.

Composition of Fluid Dielectric

The fluidic dielectric as described herein can be comprised of any fluid composition having the required characteristics of permittivity and permeability as may be necessary for achieving operation of the antenna elements over a selected set of frequency bands. For example, those skilled in the art will recognize that one or more component parts can be mixed together to produce a desired permeability and permittivity required for achieving input impedance match for elements 102.

The fluidic dielectric 114 also preferably has a relatively low loss tangent to minimize the amount of RF energy lost in each element. However, devices with higher loss may be acceptable in some instances so this may not be a critical factor. Many applications also require a broadband response. Accordingly, it may be desirable in many instances to select fluidic dielectrics that have a relatively constant response over a broad range of frequencies.

Aside from the foregoing constraints, there are relatively few limits on the range of materials that can be used to form the fluidic dielectric. Accordingly, those skilled in the art will recognize that the examples of suitable fluidic dielectrics as shall be disclosed herein are merely by way of example and are not intended to limit in any way the scope of the invention. Also, while component materials can be mixed in order to produce the fluidic dielectric as described herein, it should be noted that the invention is not so limited. Instead, the composition of the fluidic dielectric could be formed in other ways. All such techniques will be understood to be included within the scope of the invention.

Those skilled in the art will recognize that a nominal value of permittivity ($\in_r$) for fluids is approximately 2.0. However, the fluidic dielectric used herein can include fluids with higher values of permittivity. For example, the fluidic dielectric material could be selected to have a permittivity values of between 2.0 and about 58, depending upon the amount of dielectric constant change required to properly load the antenna for optimal impedance match at a given frequency.

Similarly, the fluidic dielectric can have a wide range of permeability values. High levels of magnetic permeability are commonly observed in magnetic metals such as Fe and Co. For example, solid alloys of these materials can exhibit levels of $\mu_r$ in excess of one thousand. By comparison, the permeability of fluids is nominally about 1.0 and they generally do not exhibit high levels of permeability. However, high permeability can be achieved in a fluid by introducing metal particles/elements to the fluid. For example typical magnetic fluids comprise suspensions of ferro-magnetic particles in a conventional industrial solvent such as water, toluene, mineral oil, silicone, and so on. Other types of magnetic particles include metallic salts, organometallic compounds, and other derivatives, although Fe and Co particles are most common. The size of the magnetic particles found in such systems is known to vary to some extent. However, particles sizes in the range of 1 nm to 20 $\mu$m are common. The composition of particles can be selected as necessary to achieve the required permeability in the final fluidic dielectric. Magnetic fluid compositions are typically between about 50% to 90% particles by weight. Increasing the number of particles will generally increase the permeability.

More particularly, A hydrocarbon dielectric oil such as Vacuum Pump Oil MSDS-12602 could be used to realize a low permittivity, low permeability fluid, low electrical loss fluid. A low permittivity, high permeability fluid may be realized by mixing same hydrocarbon fluid with magnetic particles such as magnetite manufactured by FerroTec Corporation of Nashua, N.H., or iron-nickel metal powders manufactured by Lord Corporation of Cary, N.C. for use in ferrofluids and magnetoresrictive (MR) fluids. Additional ingredients such as surfactants may be included to promote uniform dispersion of the particle. Fluids containing electrically conductive magnetic particles require a mix ratio low enough to ensure that no electrical path can be created in the mixture. Solvents such as formamide inherently posses a relatively high permittivity.

Similar techniques could be used to produce fluidic dielectrics with higher permittivity. For example, fluid permittivity could be increased by adding high permittivity powders such as barium titanate manufactured by Ferro Corporation of Cleveland, Ohio. For broadband applications, the fluids would not have significant resonances over the frequency band of interest.

Antenna Structure, Materials and Fabrication

According to one aspect of the invention, the dielectric substrate 106 can be formed from a ceramic material. For example, the dielectric structure can be formed from a low temperature co-fired ceramic (LTCC). Processing and fabrication of RF circuits on LTCC is well known to those skilled in the art. LTCC is particularly well suited for the present application because of its compatibility and resistance to attack from a wide range of fluids. The material also has superior properties of wetability and absorption as compared to other types of solid dielectric material. These factors, plus LTCC's proven suitability for manufacturing miniaturized RF circuits, make it a natural choice for use in the present invention.

Further, while the invention herein has been described relative to a single dipole element, it will be understood that the invention is not so limited. Thus, for example, the inventive arrangements as described herein can be used in arrays of such elements. The individual elements forming such arrays can be formed in any of the well known geometric patterns that are commonly used for planar antennas and arrays. The invention is not limited to any particular type of antenna element. Also, the elements as described herein have been disposed directly on the surface of a dielectric substrate but it should be understood that other embodiments are also possible. For example, the elements can be disposed beneath a dielectric radome layer or layers.

The valves and pumps as described herein can be formed using conventional miniature valve assemblies. However, according to a preferred embodiment, it can be desirable to fabricate such pumps and valves as micro-electromechanical machines (MEMS). Such techniques are well known in the art and can be used in the inventive the arrangements described herein to allow the devices to be manufactured more efficiently, in a more compact form factor and with greater reliability.

Antenna Band Control Process

Figure 7:
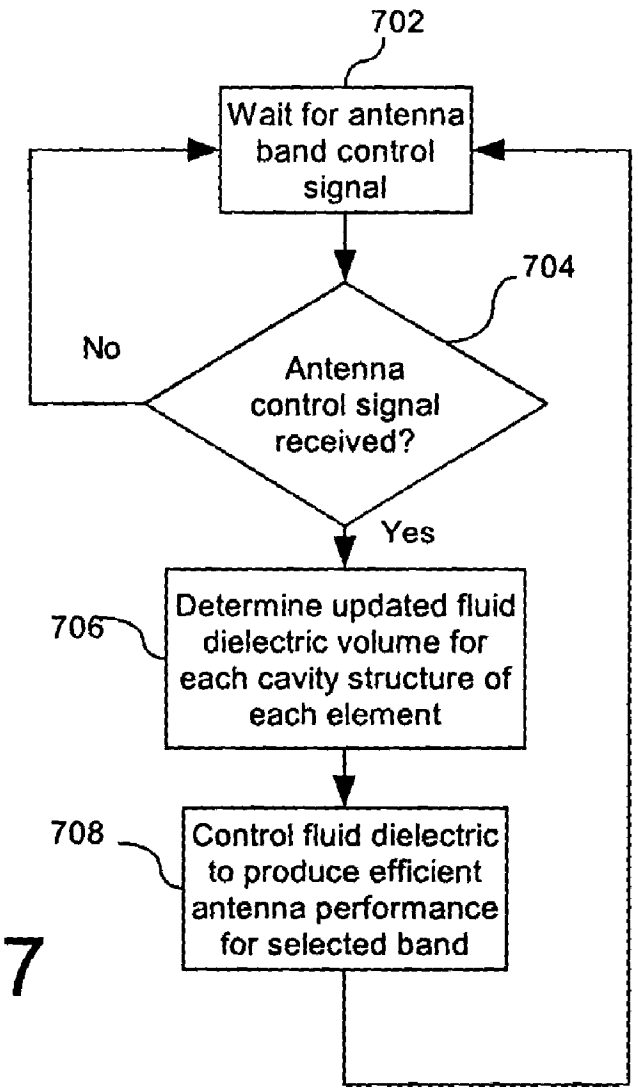
FIG. 7 is a flow chart that is useful for understanding the invention.

Referring now to FIG. 7, a process shall be described for controlling the operational band of the antenna 100. In step 702 and 704, controller 120 can wait for an antenna band control signal 124 indicating operation on a specified antenna band. Once this information has been received, the controller 120 can determine in step 706 a required phase shift for each element 102 and/or a required amount of fluid dielectric 114 that is needed for each cavity structure 108 in order to produce efficient antenna operation on a particular band. In step 708, the controller 302 can selectively operate the control pump 118 and valve 116 to produce the required electrical characteristics to allow efficient performance of the antenna element 102 on a particular band of frequencies.

As an alternative to calculating the required volume configuration of the fluid dielectric, the controller 120 could also make use of a look-up-table (LUT). The LUT can contain cross-reference information for determining control data for each antenna element 102 necessary to achieve efficient operation on a selected frequency band. For example, a calibration process could be used to identify the specific sensor 122 output data communicated to controller 120 necessary to achieve efficient performance on a selected band. These digital control signal values could then be stored in the LUT. Thereafter, when control signal 124 is updated, the controller 120 can immediately operate the pumps and valves as necessary to produce the antenna electrical characteristics required for each band.

As an alternative, or in addition to the foregoing methods, the controller 120 could make use of an empirical approach that applies a reference signal to each radiating element and then measures the SWR that occurs at each element 102. Specifically, the controller 120 can check to see whether the antenna is operating efficiently on a particular band. A feedback loop could then be employed to control each pump 118 and valve 116 to produce the desired performance on a particular frequency band.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. A method for varying an operating band of an antenna, comprising the steps of:

magnetically and electrically coupling at least one antenna element to a fluid dielectric comprising magnetic particles; and varying a volume of said fluid dielectric coupled to said at least one antenna element to selectively maximize efficiency of said antenna element on a plurality of operating bands.

2. A method for varying an operating band of an antenna, comprising the steps of:

magnetically and electrically coupling at least one antenna element to a fluid dielectric; and varying a volume of said fluid dielectric coupled to said at least one antenna element to selectively maximize efficiency of said antenna element on a plurality of operating bands and provide an efficient impedance match with an antenna feed circuit of said a least one antenna element for each of said operating bands.

3. The method according to claim 1 wherein said varying step further comprises varying said volume to selectively cause said at least one antenna element to be resonant at said plurality of operating bands.

4. The method according to claim 1 wherein said varying step further comprises varying at least one of a capacitive and a magnetic loading of said at least one antenna element.

5. The method according to claim 1 wherein said coupling step further comprises coupling said fluid dielectric to said at least one antenna element over a continuous area defined by said at least one antenna element.

6. A method for varying an operating band of an antenna, comprising the steps of:

selectively distributing fluid dielectric to a plurality of separate cavity structures coupled to at least one antenna element to magnetically and electrically couple said at least one antenna element to said fluid dielectric; and varying a volume of said fluid dielectric coupled to said at least one antenna element to selectively maximize efficiency of said antenna element on a plurality of operating bands.

7. The method according to claim 6 further comprising the step of distributing said cavity structures about an area defined by said at least one antenna element.

8. The method according to claim 6 further comprising the step of distributing said cavity structures spaced from one another along a direction extending from said at least one antenna element to a ground plane of said antenna element.

9. An antenna, comprising:

at least one antenna element;

a fluid dielectric magnetically and electrically coupled to said antenna element; and a fluid control system comprising:

a controller responsive to a control signal indicating operation on a specified antenna band and to a feedback loop communicating information associated with a performance characteristic of said antenna;

wherein said fluid control system selectively varies a volume of said fluid dielectric coupled to said antenna element to permit efficient operation of said antenna element on a plurality of operating bands.

10. The antenna according to claim 9 further wherein said antenna element is disposed on a dielectric substrate.

11. The antenna according to claim 10 wherein at least one cavity structure is defined in said dielectric substrate for constraining said fluid dielectric.

12. The antenna according to claim 11 wherein said at least one cavity structure is substantially continuous within an area defined by said at least one antenna element.

13. The antenna according to claim 11 comprising a plurality of said cavity structures.

14. The antenna according to claim 13 wherein said plurality of cavity structures are distributed about an area defined by said at least one antenna element.

15. An antenna comprising:

at least one antenna element disposed on a dielectric substrate;

a fluid dielectric magnetically and electrically coupled to said antenna element;

a fluid control system responsive to a control signal for selectively varying a volume of said fluid dielectric coupled to said antenna element, whereby operation of said antenna element is provided on a plurality of operating bands; and wherein a plurality of cavity structures are defined in said dielectric substrate for constraining said fluid dielectric, said plurality of cavity structures being spaced from one another along a direction extending from said at least one antenna element to a ground plane of said antenna element.

16. An antenna comprising:

at least one antenna element;

a fluid dielectric magnetically and electrically coupled to said antenna element;

a fluid control system responsive to a control signal for selectively varying a volume of said fluid dielectric coupled to said antenna element, whereby operation of said antenna element is provided on a plurality of operating bands;

wherein said fluid control system comprises a controller and said controller selectively varies said volume to provide an impedance match with an antenna feed circuit of said a least one antenna element for each of said operating bands.

* * * * *

UNITED STATES PATENT AND TRADEMARK OFFICE

CERTIFICATE OF CORRECTION

PATENT NO. : 6,992,628 B2
APPLICATION NO. : 10/647677
DATED : January 31, 2006
INVENTOR(S) : Rawnick et al.

It is certified that error appears in the above-identified patent and that said Letters Patent is hereby corrected as shown below:

Column 9
Line 5, insert --a-- between "distributing" and "fluid"

Column 10,
Line 41, insert the following claims:
--17. The antenna according to claim 9 wherein said fluid control system comprises a controller and said controller selectively varies said volume to cause said at least one antenna element to be resonant at said plurality of operating bands.
18. The antenna according to claim 9 wherein said fluid dielectric is comprised of magnetic particles.
19. The antenna according to claim 9 wherein said fluid control system comprises a controller and said controller selectively varies at least one of a capacitive and a magnetic loading of said at least one antenna element. --

Signed and Sealed this

Nineteenth Day of December, 2006

JON W. DUDAS
*Director of the United States Patent and Trademark Office*